US007175977B2

(12) United States Patent
Geuens et al.

(10) Patent No.: US 7,175,977 B2
(45) Date of Patent: Feb. 13, 2007

(54) STABILIZERS FOR USE IN THERMOGRAPHIC RECORDING MATERIALS

(75) Inventors: Ingrid Geuens, Emblem (BE); Johan Loccufier, Zwijnaarde (BE)

(73) Assignee: Agfa-Gevaert, Mortsel (BE)

( * ) Notice: Subject to any disclaimer, the term of this patent is extended or adjusted under 35 U.S.C. 154(b) by 18 days.

(21) Appl. No.: 11/000,407

(22) Filed: Nov. 30, 2004

(65) Prior Publication Data

US 2005/0136363 A1 Jun. 23, 2005

Related U.S. Application Data

(60) Provisional application No. 60/536,030, filed on Jan. 13, 2004.

(30) Foreign Application Priority Data

Dec. 18, 2003 (EP) ..... 03104801

(51) Int. Cl.
*B41M 5/20* (2006.01)
*G03C 1/34* (2006.01)

(52) U.S. Cl. ..... 430/613; 430/600; 430/603; 430/614; 430/615; 503/201; 503/212

(58) Field of Classification Search ..... 430/617, 430/619, 600, 603, 613, 614, 615; 503/201, 503/212

See application file for complete search history.

(56) References Cited

U.S. PATENT DOCUMENTS

| | | | |
|---|---|---|---|
| 3,074,809 | A | 1/1963 | Owen |
| 3,446,648 | A | 5/1969 | Workman |
| 3,457,075 | A | 7/1969 | Morgan et al. |
| 3,844,797 | A | 10/1974 | Willems et al. |
| 3,951,660 | A | 4/1976 | Hagemann et al. |
| 4,082,901 | A | 4/1978 | Laridon et al. |
| 4,201,582 | A | 5/1980 | White |
| 4,451,561 | A | 5/1984 | Hirabayashi et al. |
| 4,543,309 | A | 9/1985 | Hirabayashi et al. |
| 4,956,260 | A | 9/1990 | Nakamura |
| 5,374,514 | A | 12/1994 | Kirk et al. |
| 5,464,738 | A | 11/1995 | Lynch et al. |
| 5,496,695 | A | 3/1996 | Simpson et al. |
| 5,545,505 | A | 8/1996 | Simpson |
| 5,545,507 | A | 8/1996 | Simpson et al. |
| 5,545,515 | A | 8/1996 | Murray et al. |
| 5,558,983 | A | 9/1996 | Simpson et al. |
| 5,599,647 | A | 2/1997 | Defieuw et al. |
| 5,635,339 | A | 6/1997 | Murray |
| 5,654,130 | A | 8/1997 | Murray |
| 6,348,308 | B1 | 2/2002 | Loccufier et al. |

FOREIGN PATENT DOCUMENTS

| | | | |
|---|---|---|---|
| EP | 0 573 048 | A2 | 12/1993 |
| EP | 0 622 217 | A1 | 11/1994 |
| EP | 0 654 355 | A1 | 5/1995 |
| EP | 0 692 733 | A2 | 1/1996 |
| EP | 0 713 133 | A1 | 5/1996 |
| EP | 0 736 799 | A1 | 10/1996 |
| EP | 0 901 040 | A1 | 3/1999 |
| EP | 0 903 625 | A1 | 3/1999 |
| EP | 0 964 300 | A1 | 12/1999 |
| GB | 1 501 005 | | 2/1978 |
| JP | 09-295456 | | 11/1997 |
| JP | 2002 207270 | A | 7/2002 |
| WO | WO 94/16361 | A1 | 7/1994 |
| WO | WO 97/048104 | A1 | 12/1997 |
| WO | WO 97/048105 | A1 | 12/1997 |

OTHER PUBLICATIONS

Cohen (ed.); *Modern Coating and Drying Technology*, New York, NY, VCH Publishers Inc. (1990).

Harbison et al., The Theory of The Photographic Process 4rth edition (James ed.), Chapter 5, 149-169, 374, Macmillan Company, New York, NY (1977).

*Primary Examiner*—Thorl Chea
(74) *Attorney, Agent, or Firm*—Leydig, Voit & Mayer, Ltd

(57) ABSTRACT

A black and white monosheet thermographic recording material comprising a support and a thermosensitive element, the thermosensitive element containing a substantially light-insensitive organic silver salt, an organic reducing agent therefor in thermal working relationship therewith, a binder and at least one five-membered heterocyclic ring compound selected from the group consisting of optionally substituted, optionally annelated 1-thia-2,3-diazole compounds; optionally substituted, optionally annelated 1-thia-2,5-diazole compounds; optionally substituted 1-thia-2,4-diazole compounds; optionally substituted 1-thia-3,4-diazole compounds; optionally substituted thiatriazole compounds; optionally substituted, optionally annelated 1-seleno-2,3-diazole compounds; optionally substituted, optionally annelated 1-seleno-2,5-diazole compounds; optionally substituted 1-seleno-2,4-diazole compounds; optionally substituted 1-seleno-3,4-diazole compounds; and optionally substituted selenotriazole compounds, with the proviso that the at least one compound is not substituted with or contain a mercapto, a —$SO_2CBr_3$, a —S-alkylene-COOH or a N-acyl-hydrazine group.

11 Claims, No Drawings

STABILIZERS FOR USE IN THERMOGRAPHIC RECORDING MATERIALS

This application claims the benefit of U.S. Provisional Application No. 60/536,030 filed Jan. 13, 2004, which is herein incorporated by reference. In addition, this application claims the benefit of European Application No. 03104801.0 filed Dec. 18, 2003, which is also herein incorporated by reference.

FIELD OF THE INVENTION

The present invention concerns stabilizers for use in substantially light-insensitive thermographic recording materials.

BACKGROUND OF THE INVENTION

Thermography is an image-forming process including a heating step and hence includes photothermography in which the image-forming process includes image-wise exposure and direct thermal processes in which the image-forming process includes an image-wise heating step. In direct thermal printing a visible image pattern is produced by image-wise heating of a recording material.

U.S. Pat. No. 4,451,561 discloses a heat-development-type image recording material comprising on a support a heat-development-type image recording layer containing (a) an organic silver salt, (b) a reducing agent, (c) a binder, and (d) at least one compound of following formula [I]:

(I)

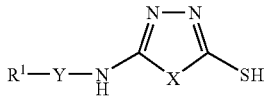

wherein $R^1$ represents a hydrogen atom, a hydroxy radical or a substituted or unsubstituted alkyl, alkenyl, aryl or alkoxy radical; Y represents a sulfonyl or a carbonyl radical; and X represents a sulfur atom or $=N—R^2$ wherein $R^2$ is a hydrogen atom, an amino radical or a substituted or unsubstituted alkyl, aryl or alkenyl radical. U.S. Pat. No. 4,451,561 further discloses the presence of an additional compound of following formula [II]:

(II)

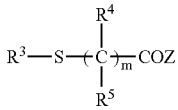

wherein $R^3$ represents a substituted or unsubstituted alkyl, aryl or heterocyclic radical; $R^4$ and $R^5$ each represent a hydroxy or a substituted or unsubstituted alkyl, aryl or heterocyclic radical; Z represents a hydroxy or an amino radical; and m is an integer of 1 or 2. Specifically the following compounds according to formula [I] are disclosed:

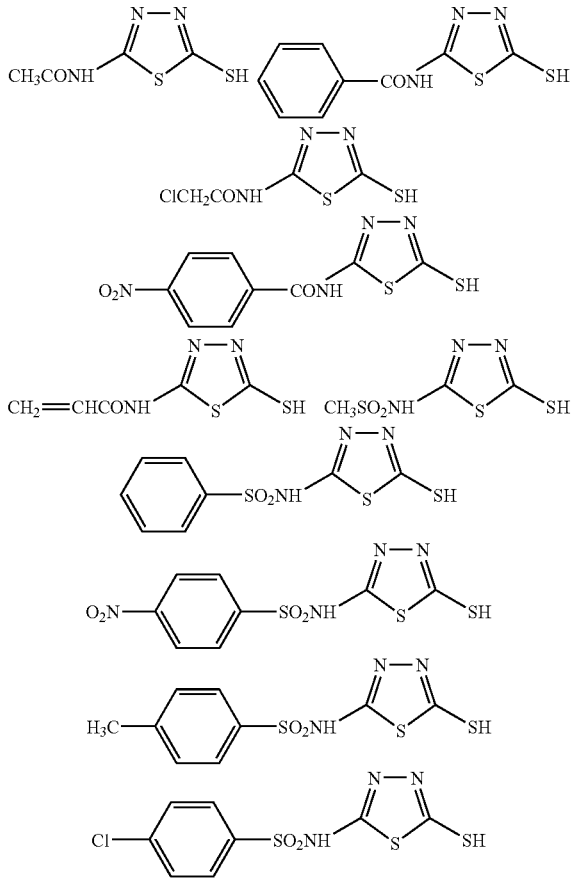

and the following compounds according to formula (II) are disclosed:

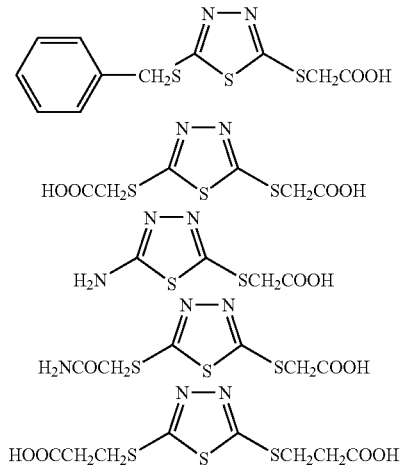

U.S. Pat. No. 4,543,309 discloses a heat-developable image-pattern recording material of enhanced developability and stability having on a support a heat-developable image-pattern recording layer containing (a) a silver salt of a benzotriazole, (b) a reducing agent, (c) a binder, (d) at least one compound having the following formula:

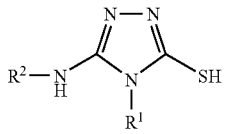

wherein $R^1$ represents a hydrogen, an amino radical, or a substituted or unsubstituted alkyl, alkenyl or aryl radical; $R^2$ represents a hydrogen, an amino, alkyl, alkenyl or aryl radical; and further contains a compound of the formula:

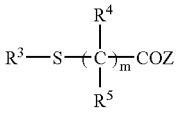

wherein $R^3$ represents a substituted or unsubstituted alkyl, aryl or heterocyclic radical; $R^4$ and $R^5$ each represent a hydroxy or a substituted or unsubstituted alkyl, aryl or heterocyclic radical; Z represents a hydroxy or an amino radical; and m is an integer of 1 or 2. Specifically the following compounds according to formula (II) are disclosed:

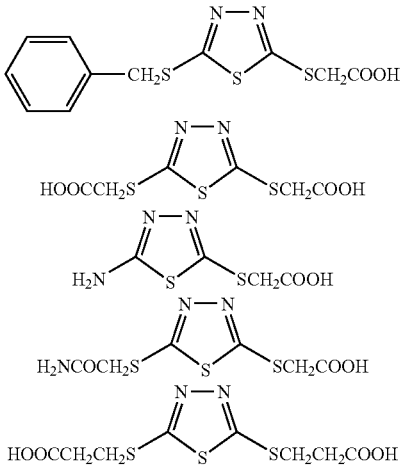

U.S. Pat. No. 5,374,514 discloses a photothermographic material comprising photographic silver halide, a reducible silver source, a reducing agent for silver ion, and a binder, and, as an antifoggant and/or image stabilizer, a compound of the formula:

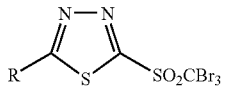

wherein: R is a member selected from the group consisting of a hydrogen atom, an alkyl group, an aryl group and a heterocyclic group.

JP 09-295456 discloses a method of obtaining an image which is long in shelf life and high in density, wherein at least one side of an organic silver salt or developer of organic silver salt is contained in a heat response property micro-capsule, and at least one kind in a group of compounds of a specific formula as a fog inhibitor is contained in a recording layer, the group of compounds including 1-thia-3,4-diazole-tribromomethylsulfone.

EP-A 0 713 133 discloses a thermal imaging system consisting of (i) a donor element comprising on a support a donor layer containing a binder and a thermotransferable reducing agent capable of reducing a silver source to metallic silver and (ii) a receiving element comprising on a support a receiving layer comprising a silver source, capable of being reduced by means of heat in the presence of a reducing agent, a binder and a stabiliser selected from the group consisting of benzotriazoles, heterocyclic mercaptanes, sulphinic acids, 1,3,4-triazo-indinolines, 1,3-dinitroaryl compounds, 1,2,3-triazoles, phthalic acids and phthalic acid derivatives.

EP-A 0 901 040, which corresponds to U.S. Pat. No. 6,348,308, discloses a substantially light-insensitive monosheet recording material comprising a support and a thermosensitive element containing a substantially light-insensitive organic silver salt, an organic reducing agent therefor in thermal working relationship therewith and a binder, characterized in that said thermosensitive element further contains an unsaturated carbocyclic or heterocyclic stabilizer compound substituted with a —SA group where A is hydrogen, a counterion to compensate the negative charge of the thiolate group or a group forming a symmetrical or an asymmetrical disulfide and said recording material is capable of producing prints with a numerical gradation value defined as the quotient of the fraction $(2.5-0.1)/(E_{2.5}-E_{0.1})$ greater than 2.3, where $E_{2.5}$ is the energy in Joule applied in a dot area of 87 μm×87 μm of the imaging layer that produces an optical density value of 2.5, and $E_{0.1}$ is the energy in Joule applied in a dot area of the imaging layer material that produces an optical density value of 0.1.

WO 94/16361 discloses a multilayer heat-sensitive material which comprises: a color-forming layer comprising: a color-forming amount of finely divided, solid colorless noble metal or iron salt of an organic acid distributed in a carrier composition; a color-developing amount of a cyclic or aromatic organic reducing agent, which at thermal copy and printing temperatures is capable of a color-forming reaction with the noble metal or iron salt; and an image-toning agent; characterized in that (a) the carrier composition comprises a substantially water-soluble polymeric carrier and a dispersing agent for the noble metal or iron salt and (b) the material comprises a protective overcoating layer for the color-forming layer. Furthermore, WO 94/16361 discloses that suitable antifoggants are well-known photographic anti-foggants such as mercaptobenzotriazole, chromate, oxalate, citrate, carbonate, benzotriazole (BZT), 5-methylbenzotriazole, 5,6-dimethylbenzotriazole, 5-bromobenzotriazole, 5-chlorobenzotriazole, 5-nitro-benzotriazole, 4-nitro-6-chlorobenzotriazole, 5-nitro-6-chlorobenzotriazole, 4-hydroxy-6-methyl-1,3,3a,7-tetraazaindene, benzimidazole, 2-methylbenz-imidazole, 5-nitrobenzimidazole, 1-phenyl-5-mercaptotetrazole, 2-mercaptobenzimidazole, 2-mercaptobenzothiazole, 2-mercaptobenzoxazole, 2-mercaptothiazoline, 2-mercapto-4-methyl-6,6'-dimethylpyrimidine, 1-ethyl-2-mercapto-5-amino-1,3,4-triazole, 1-ethyl-5-mercapto-1,2,3,4-tetrazole, 2,5-dimercapto-1,3,4-thiodiazole, 2-mercapto-5-aminothiodiazole, dimethyldithiocarbamate, and diethyldithiocarbamate.

U.S. Pat. No. 5,558,983 discloses a photothermographic element comprising a support bearing at least one photosensitive, image-forming, photothermographic emulsion layer comprising: (a) a photosensitive silver halide; (b) a non-photosensitive, reducible silver source; (c) a reducing agent system for silver ion; and (d) a binder; wherein said reducing agent system comprises: (i) at least one hindered phenol; (ii) at least one co-developer of the formula $R^1$—(C═O)—NHNH—$R^2$ wherein: $R^1$ represents hydrogen and $R^2$ represents an aryl or substituted aryl group; or, $R^1$ represents hydrogen, alkyl, or alkenyl groups of 1 to 20 carbon atoms; alkoxy, thioalkoxy, or amido groups of 1 to 20 carbon atoms; aryl, alkaryl, or aralkyl groups of up to 20 carbon atoms; aryloxy, thioaryloxy, or anilino groups of up to 20 carbon atoms; aliphatic or aromatic heterocyclic ring groups containing up to 6 ring atoms; carbocyclic ring groups comprising up to 6 ring carbon atoms; or fused ring or bridging groups comprising up to 14 ring atoms; and $R^2$ represents a trityl group; and (iii) at least one N-acyl-hydrazine compound of the formula $R_3$—(C═O)—NH—$NH_2$ wherein: $R^3$ represents an alkyl or alkenyl groups of 1 to 20 carbon atoms; alkoxy, thioalkoxy, or amido groups of up to 20 carbons; aryl, alkaryl or aralkyl groups comprising up to 20 carbon atoms; aryloxy, thioaryloxy, or anilino groups of up to 20 carbon atoms; aliphatic or aromatic heterocyclic ring groups containing up to 6 ring atoms; carbocyclic ring groups comprising up to 6 ring carbon atoms; or fused ring or bridging groups comprising up to 14 ring atoms. U.S. Pat. No. 5,558,983 also discloses a thermographic element comprising a support bearing at least one, image-forming, thermographic emulsion layer comprising: (a) a non-photosensitive, reducible silver source; (b) a reducing agent system for silver ion; and (c) a binder; wherein said reducing agent system comprises: (i) at least one hindered phenol; (ii) at least one co-developer of the formula $R^1$—(C═O)—NHNH—$R^2$ wherein: $R^1$ represents hydrogen and $R^2$ represents an aryl group; or, $R^1$ represents hydrogen, alkyl or alkenyl groups of 1 to 20 carbon atoms; alkoxy, thioalkoxy, or amido groups of 1 to 20 carbon atoms; aryl, alkaryl, or aralkyl groups of up to 20 carbon atoms; aryloxy, thioaryloxy, or anilino groups of up to 20 carbon atoms; aliphatic or aromatic heterocyclic ring groups containing up to 6 ring atoms; carbocyclic ring groups comprising up to 6 ring carbon atoms; or fused ring or bridging groups comprising up to 14 ring atoms; and $R^2$ represents a trityl group; and (iii) at least one N-acyl-hydrazine compound of the formula $R^3$—(C═O)—NH—$NH_2$ wherein $R^3$ represents an alkyl or alkenyl groups of 1 to 20 carbon atoms; alkoxy, thioalkoxy, or amido groups of 1 to 20 carbons; aryl, alkaryl or aralkyl groups comprising up to 20 carbon atoms; aryloxy, thioaryloxy, or anilino groups of up to 20 carbon atoms; aliphatic or aromatic heterocyclic ring groups containing up to 6 ring atoms; carbocyclic ring groups comprising up to 6 ring carbon atoms; or fused ring or bridging groups comprising up to 14 ring atoms. Furthermore, U.S. Pat. No. 5,558,983 also discloses the compound CA-3:

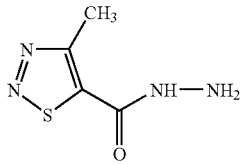

GB-A 1,501,005 discloses a sensitive photothermographic material which comprises a support coated on one side with a composition containing (a) a photographic silver halide, (b) an image-forming combination comprising (i) a silver salt of a heterocyclic thione of the formula

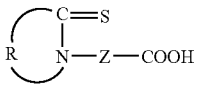

wherein R represents atoms which complete an unsubstituted or substituted heterocyclic ring and Z is an alkylene group having from 1 to 30 carbon atoms and (ii) an organic reducing agent therefor, and (c) a toner which is a mercaptoheterocyclic compound which gives by the test procedure specified herein, a δD value of from zero to 0.21, the components of the composition being disposed in one or more layers.

Differences Between Substantially Light-Insensitive Thermographic Recording Materials and Photothermographic Recording Materials The technology of substantially light-insensitive thermographic materials in which image formation is based on the reduction of organic silver salts is significantly different from that of photothermographic recording materials, despite the fact that in both cases the image results from the reduction of organic silver salts. However, this a superficial similarity masking the fact that the realization of the species which catalyze this reduction is completely different, being image-wise exposure of photosensitive silver halide-containing photo-addressable thermally developable elements in the case of photothermographic recording materials and image-wise heating of thermosensitive elements which do not contain photosensitive silver halide in the case of thermographic recording materials. This difference in technology is further underlined by the nature of the ingredients used in the two types of materials, the most significant difference being the absence of photosensitive silver halide and spectral sensitizing agents in substantially light-insensitive thermographic recording materials, but also reflected in the different reducing agents used, stronger reducing agents being used in substantially light-insensitive thermographic recording materials, the different stabilizers, the different toning agents etc. Furthermore, the thermal development processes themselves are significantly different in that the whole material is heated at temperatures of less than 150° C. for periods of seconds (e.g. 10 s) in the case of photothermographic recording materials, whereas in the case of substantially light-insensitive thermographic recording materials the materials are image-wise heated at much higher temperatures for periods of ms (e.g. 10–20 ms). Realization of a neutral image tone is a major problem in the case of substantially light-insensitive thermographic recording materials due to the very short heating times, whereas it is much less of a problem in photothermographic recording materials due to the much longer heating times.

Problem to be Solved

Substantially light-insensitive thermographic recording materials contain the imaging-forming components after image formation and unwanted image-forming in prints must be hindered during storage and upon exposure to light on light-boxes e.g. during examination by radiologists. Furthermore, prior art stabilizers can substantially reduce after image formation and unwanted image-forming during storage and upon exposure to light, but retard the image-forming process thereby reducing the maximum achievable image density and the stabilizer and/or the products of its reaction with other ingredients diffuse to the surface of the substantially light-insensitive thermographic recording material both during and after the image-forming process. There is therefore a need for compounds which provide stabilizing properties, but without the drawback of retarding the image-forming process.

ASPECTS OF THE INVENTION

It is therefore an aspect of the present invention to provide compounds which endow substantially light-insensitive thermographic recording materials with a higher Dmax for a given coverage per unit area of substantially light-insensitive organic silver salt.

It is therefore a further aspect of the present invention to provide compounds which endow substantially light-insensitive thermographic recording materials with good archivability.

It is therefore also an aspect of the present invention to provide compounds which endow substantially light-insensitive thermographic recording materials with good photostability.

Further aspects and advantages of the invention will become apparent from the description hereinafter.

SUMMARY OF THE INVENTION

It has been surprisingly found that specific types of optionally substituted, optionally annelated five-membered heterocyclic ring compound provide effective stabilization in substantially light-insensitive thermographic recording materials, while not retarding the image-forming process.

Aspects of the present invention are realized with a black and white monosheet thermographic recording material comprising a support and a thermosensitive element, the thermosensitive element containing a substantially light-insensitive organic silver salt, an organic reducing agent therefor in thermal working relationship therewith, a binder and at least one five-membered heterocyclic ring compound selected from the group consisting of optionally substituted, optionally annelated 1-thia-2,3-diazole compounds; optionally substituted, optionally annelated 1-thia-2,5-diazole compounds; optionally substituted 1-thia-2,4-diazole compounds; optionally substituted 1-thia-3,4-diazole compounds; optionally substituted thiatriazole compounds; optionally substituted, optionally annelated 1-seleno-2,3-diazole compounds; optionally substituted, optionally annelated 1-seleno-2,5-diazole compounds; optionally substituted 1-seleno-2,4-diazole compounds; optionally substituted 1-seleno-3,4-diazole compounds; and optionally substituted selenotriazole compounds, with the proviso that the at least one compound is not substituted with or contain a mercapto, a —$SO_2CBr_3$, a —S-alkylene-COOH or a N-acyl-hydrazine group.

Preferred embodiments of the present invention are disclosed in the detailed description of the invention.

DETAILED DESCRIPTION OF THE INVENTION

Definitions

The term alkyl means all variants possible for each number of carbon atoms in the alkyl group i.e. for three carbon atoms: n-propyl and isopropyl; for four carbon atoms: n-butyl, isobutyl and tertiary-butyl; for five carbon atoms: n-pentyl, 1,1-dimethyl-propyl, 2,2-dimethylpropyl and 2-methyl-butyl etc.

The term acyl group as used in disclosing the present invention means —(C═O)-aryl and —(C═O)-alkyl groups.

The L*, a* and b* CIELAB-values are defined in ASTM Norm E179-90 in a R(45/0) geometry with evaluation according to ASTM Norm E308-90.

The term thermographic recording material as used in disclosing the present invention includes both substantially light-insensitive thermographic recording materials and photothermographic recording materials.

Substantially light-insensitive means not intentionally light sensitive.

A mercapto as used in disclosing the presence invention is a —SH group or an ionized —SH group e.g. as an ammonium or alkali metal ion salt.

Annelated as used in disclosing the present invention means that two adjacent atoms in the five-membered heterocyclic ring compound, according to the present invention, and the bond between these two adjacent atoms is included in a further ring system.

Heating in association with the expression a substantially water-free condition as used herein, means heating at a temperature of 80 to 250° C. The term "substantially water-free condition" as used herein means that the reaction system is approximately in equilibrium with water in the air, and water for inducing or promoting the reaction is not particularly or positively supplied from the exterior to the element. Such a condition is described in T. H. James, "The Theory of the Photographic Process", Fourth Edition, Macmillan 1977, page 374.

Thermographic Recording Material

According to a first embodiment of the black and white monosheet thermographic recording material, according to the present invention, the thermographic recording material is a substantially light-insensitive thermographic recording material.

According to a second embodiment of the black and white monosheet thermographic recording material, according to the present invention, the thermosensitive element further contains photosensitive silver halide and thereby becomes a photothermographic recording material.

Thermosensitive Element

The term thermosensitive element as used herein is that element which contains all the ingredients which contribute to image formation. According to the present invention, the thermosensitive element contains one or more substantially light-insensitive organic silver salts, one or more reducing agents therefor in thermal working relationship therewith and a binder. The element may comprise a layer system in which the above-mentioned ingredients may be dispersed in different layers, with the proviso that the substantially light-insensitive organic silver salts are in reactive association with the reducing agents i.e. during the thermal development process the reducing agent must be present in such a way that it is able to diffuse to the particles of substantially light-insensitive organic silver salt so that reduction to silver can occur. Such materials include the possibility of one or more substantially light-insensitive organic silver salts and/or one of more organic reducing agents therefor being encapsulated in heat-responsive microcapsules, such as disclosed in EP-A 0 736 799 herein incorporated by reference.

When photosensitive silver halide is present in the thermosensitive element, the thermosensitive element becomes a photo-addressable thermally developable element.

Five-Membered Heterocyclic Ring Compounds

Aspects of the present invention are realized with a black and white monosheet thermographic recording material comprising a support and a thermosensitive element, the thermosensitive element containing a substantially light-insensitive organic silver salt, an organic reducing agent therefor in thermal working relationship therewith, a binder and at least one five-membered heterocyclic ring compound selected from the group consisting of optionally substituted, optionally annelated 1-thia-2,3-diazole compounds; optionally substituted, optionally annelated 1-thia-2,5-diazole compounds; optionally substituted 1-thia-2,4-diazole compounds; optionally substituted 1-thia-3,4-diazole compounds; optionally substituted thiatriazole compounds; optionally substituted, optionally annelated 1-seleno-2,3-diazole compounds; optionally substituted, optionally annelated 1-seleno-2,5-diazole compounds; optionally substituted 1-seleno-2,4-diazole compounds; optionally substituted 1-seleno-3,4-diazole compounds; and optionally substituted selenotriazole compounds, with the proviso that the at least one compound is not substituted with or contain a mercapto, a —$SO_2CBr_3$, a —S-alkylene-COOH or a N-acyl-hydrazine group.

The optional substitution of the five-membered heterocyclic ring compound is a halogen atom or an optionally substituted alkyl, alkenyl, alkynyl, alicyclic, aryl, aralkyl, alkaryl, heterocyclic, heteroaromatic, alkoxy, thio-alkoxy, aryloxy, amino, amido, carboxy, carboxy ester, acyl, carbonato, carbonato-ester or a $SO_2R$ group wherein R is an alkyl, alkenyl, alkynyl, alicyclic, aryl, aralkyl, alkaryl, heterocyclic or heteroaromatic group; or two adjacent groups can together constitute the atoms necessary to form an optionally substituted heterocyclic, alicyclic, aromatic or heteroaromatic ring or ring system. Optional substitution of the substituents on the five-membered heterocyclic ring compound includes substitution with one or more of an alkyl, an aryl, an alkoxy, a thioalkoxy, an aryloxy, a hydroxy, a five-membered ring system and a —S-five-membered heterocyclic ring system group.

According to a third embodiment of the black and white monosheet thermographic recording material, according to the present invention, the at least one five-membered heterocyclic ring compound is not substituted with and does not contain a —S—S— or a —NH—(C═S)—NH— group.

The optional annelation of the five-membered heterocyclic ring compound is with an aromatic, alicylic or heterocyclic ring system. Examples of suitable aromatic ring systems are a benzene, naphthalene, anthracene, phenanthrene ring system. Examples of suitable alicyclic ring systems are a cyclohexane, cyclohexene and a cyclohexadiene ring system. Examples of suitable heterocyclic ring systems are a pyridine, a quinoline, an isoquinoline, a tetrahydropyridine and a dihydropyridine ring system and a cyclohexane or benzene ring annelated with a five membered heterocyclic ring.

According to a fourth embodiment of the black and white monosheet thermographic recording material, according to the present invention, the at least one optionally annelated five-membered heterocyclic ring compound is annelated with a benzene or a naphthalene ring.

The five-membered heterocyclic ring compounds used in the thermographic recording materials of the present invention can be prepared using classical organic preparative techniques known to one skilled in the art.

Thiadiazole Compounds

According to a fifth embodiment of the black and white monosheet thermographic recording material, according to the present invention, the at least one five-membered heterocyclic ring compound is selected from the group consisting of optionally substituted, optionally annelated 1-thia-2,3-diazole compounds; optionally substituted, optionally annelated 1-thia-2,5-diazole compounds; optionally substituted 1-thia-2,4-diazole compounds; and optionally substituted 1-thia-3,4-diazole compounds.

According to a sixth embodiment of the black and white monosheet thermographic recording material, according to the present invention, the at least one five-membered heterocyclic ring compound is represented by formula (I):

(I)

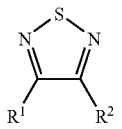

where $R^1$ and $R^2$ are independently a hydrogen or a halogen atom or an optionally substituted alkyl, alkenyl, alkynyl, alicyclic, aryl, aralkyl, alkaryl, heterocyclic, heteroaromatic, alkoxy, thio-alkoxy, aryloxy, amino, amido, carboxy, carboxy ester, acyl, carbonato, carbonato-ester or a $SO_2R^3$ group wherein $R^3$ is an alkyl, alkenyl, alkynyl, alicyclic, aryl, aralkyl, alkaryl, heterocyclic or heteroaromatic group; or $R^1$ and $R^2$ together constitute the atoms necessary to form an optionally substituted heterocyclic, alicyclic, aromatic or heteroaromatic ring or ring system.

According to a seventh embodiment of the black and white monosheet thermographic recording material, according to the present invention, the at least one five-membered heterocyclic ring compound is represented by formula (II):

(II)

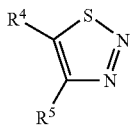

where $R^4$ and $R^5$ are independently a hydrogen or a halogen atom or an optionally substituted alkyl, alkenyl, alkynyl, alicyclic, aryl, aralkyl, alkaryl, heterocyclic, heteroaromatic, alkoxy, thio-alkoxy, aryloxy, amino, amido, carboxy, carboxy ester, acyl, carbonato, carbonato-ester or a $SO_2R^6$ group wherein $R^6$ is an alkyl, alkenyl, alkynyl, alicyclic, aryl, aralkyl, alkaryl, heterocyclic or heteroaromatic group; or $R^4$ and $R^5$ together constitute the atoms necessary to form an optionally substituted heterocyclic, alicyclic, aromatic or heteroaromatic ring or ring system.

According to an eighth embodiment of the black and white monosheet thermographic recording material, according to the present invention, the at least one five-membered heterocyclic ring compound is represented by formula (III):

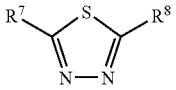

(III)

where $R^7$ and $R^8$ are independently a hydrogen or a halogen atom or an optionally substituted alkyl, alkenyl, alkynyl, alicyclic, aryl, aralkyl, alkaryl, heterocyclic, heteroaromatic, alkoxy, thio-alkoxy, aryloxy, amino, amido, carboxy, carboxy ester, acyl, carbonato, carbonato-ester or a $SO_2R^9$ group wherein $R^9$ is an alkyl, alkenyl, alkynyl, alicyclic, aryl, aralkyl, alkaryl, heterocyclic or heteroaromatic group.

According to a ninth embodiment of the black and white monosheet thermographic recording material, according to the present invention, the at least one five-membered heterocyclic ring compound is represented by formula (IV):

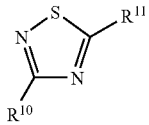

(IV)

where $R^{10}$ and $R^{11}$ are independently a hydrogen or a halogen atom or an optionally substituted alkyl, alkenyl, alkynyl, alicyclic, aryl, aralkyl, alkaryl, heterocyclic, heteroaromatic, alkoxy, thio-alkoxy, aryloxy, amino, amido, carboxy, carboxy ester, acyl, carbonato, carbonato-ester or a $SO_2R^{12}$ group wherein $R^{12}$ is an alkyl, alkenyl, alkynyl, alicyclic, aryl, aralkyl, alkaryl, heterocyclic or heteroaromatic group.

According to a tenth embodiment of the black and white monosheet thermographic recording material, according to the present invention, the at least one five-membered heterocyclic ring compound is selected from the group consisting of

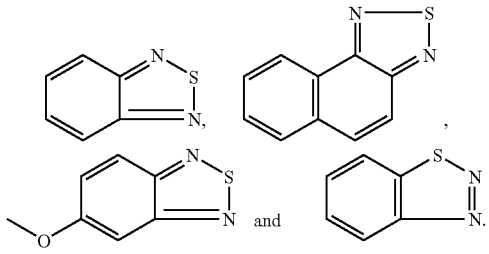

Suitable thiadiazole (TDZ) compounds, for use in the thermographic recording materials, according to the present invention include:

| Thiadiazole compound nr. | |
|---|---|
| TDZ-01 | 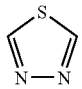 |
| TDC-02 | 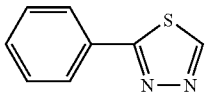 |
| TDZ-03 | 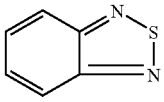 |
| TDZ-04 | 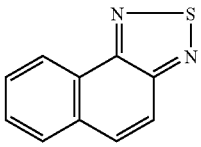 |

-continued
| Thiadiazole compound nr. | |
|---|---|
| TDZ-05 | 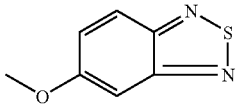 |
| TDZ-06 | 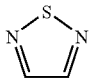 |
| TDZ-07 | 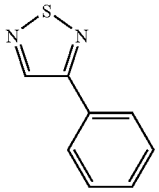 |
| TDZ-08 | 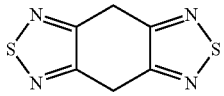 |
| TDZ-09 | 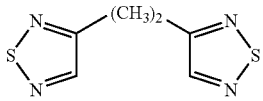 |
| TDZ-10 | 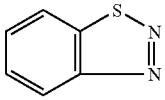 |
| TDZ-11 | 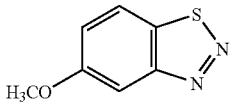 |
| TDZ-12 | 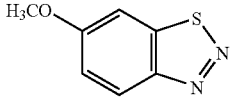 |
| TDZ-13 | 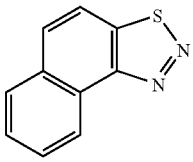 |
| TDZ-14 | 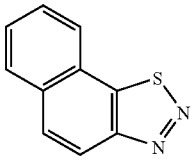 |
| TDZ-15 | 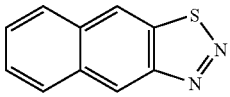 |
| TDZ-16 | 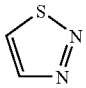 |

-continued
| Thiadiazole compound nr. | |
|---|---|
| TDZ-17 | 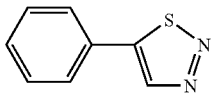 |
| TDZ-1B | 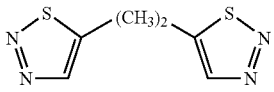 |
| TDZ-19 | 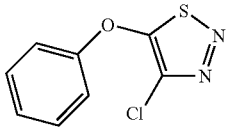 |
| TDZ-20 | 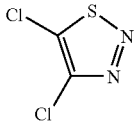 |
| TDZ-21 | 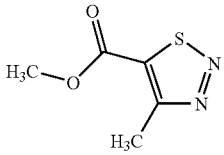 |
| TDZ-22 | 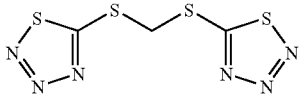 |
| TDZ-23 | 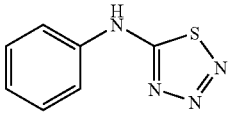 |
| TDZ-24 | 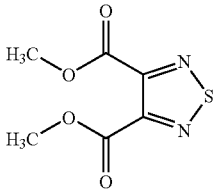 |
| TDZ-25 | 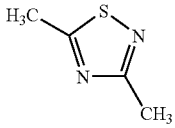 |
| TDZ-26 | 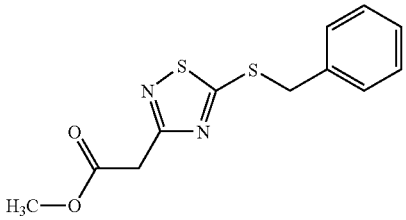 |

-continued
| Thiadiazole compound nr. | |
|---|---|
| TDZ-27 | 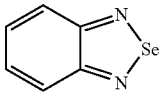 |
| TDZ-28 | 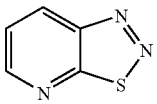 |
| TDZ-29 | 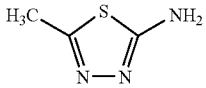 |
| TDZ-30 | 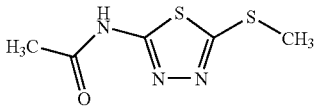 |
| TDZ-31 | 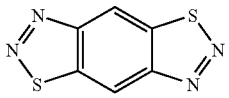 |
| TDZ-32 | 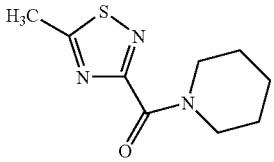 |
| TDZ-33 | 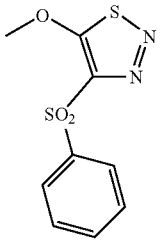 |
| TDZ-34 | 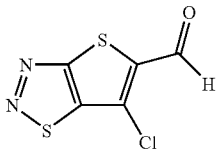 |
| TDZ-35 | 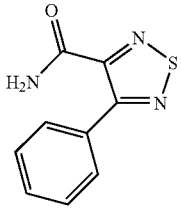 |
| TDZ-36 | 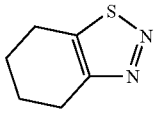 |

-continued

| Thiadiazole compound nr. | |
|---|---|
| TDZ-37 | 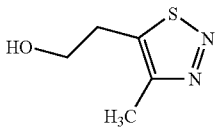 |
| TDZ-38 | 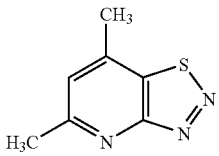 |
| TDZ-39 | 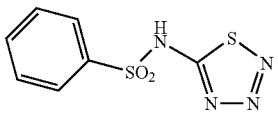 |
| TDZ-40 | 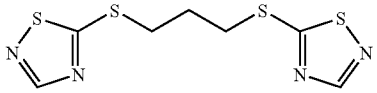 |
| TDZ-41 | 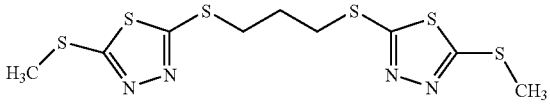 |

Organic Silver Salt

According to an eleventh embodiment of the black and white monosheet thermographic recording material of the present invention, the organic silver salts are not double organic salts containing a silver cation associated with a second cation e.g. magnesium or iron ions.

According to a twelfth embodiment of the black and white monosheet thermographic recording material of the present invention, at least one of the organic silver salts is a substantially light-insensitive silver salt of an organic carboxylic acid.

According to a thirteenth embodiment of the black and white monosheet thermographic recording material of the present invention, at least one of the organic silver salts is a substantially light-insensitive silver salt of an aliphatic carboxylic acids known as a fatty acid, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Other silver salts of an organic carboxylic acid as described in GB-P 1,439,478, e.g. silver benzoate, may likewise be used to produce a thermally developable silver image. Combinations of different silver salt of an organic carboxylic acids may also be used in the present invention, as disclosed in EP-A 964 300.

Organic silver salts may be dispersed by standard dispersion techniques. Ball mills, bead mills, microfluidizers, ultrasonic apparatuses, rotor stator mixers etc. have been found to be useful in this regard. Mixtures of organic silver salt dispersions produced by different techniques may also be used to obtain the desired thermographic properties e.g. of coarser and more finely ground dispersions of organic silver salts.

Reducing Agents

According to a fourteenth embodiment of the black and white thermographic recording material, according to the present invention, the reducing agent is an organic compound containing at least one active hydrogen atom linked to O, N or C, such as is the case with, aromatic di- and tri-hydroxy compounds. 1,2-dihydroxy-benzene derivatives, such as catechol, 3-(3,4-dihydroxyphenyl) propionic acid, 1,2-dihydroxybenzoic acid, gallic acid and esters e.g. methyl gallate, ethyl gallate, propyl gallate, tannic acid, and 3,4-dihydroxy-benzoic acid esters are preferred, with those described in EP-A 0 692 733 and EP-A 0 903 625 being particularly preferred.

Combinations of reducing agents may also be used that on heating become reactive partners in the reduction of the one or more substantially light-insensitive organic silver salt. For example, combinations of sterically hindered phenols with sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents as disclosed in U.S. Pat. No. 5,545,505, U.S. Pat. No. 5,545,507 and U.S. Pat. No. 5,558,983; acrylonitrile compounds as disclosed in U.S. Pat. No. 5,545,515 and U.S. Pat. No. 5,635,339; and 2-substituted malonodialdehyde compounds as disclosed in U.S. Pat. No. 5,654,130.

Binder of the Thermosensitive Element

The film-forming binder of the thermosensitive element may be all kinds of natural, modified natural or synthetic resins or mixtures of such resins, in which the at least one organic silver salt can be dispersed homogeneously either in aqueous or solvent media: e.g. cellulose derivatives, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylates, polymethacrylates, polystyrene and polyethylene or mixtures thereof.

Suitable water-soluble film-forming binders for use in thermographic recording materials according to the present invention are: polyvinyl alcohol, polyacrylamide, polymethacrylamide, polyacrylic acid, polymethacrylic acid, polyvinylpyrrolidone, polyethyleneglycol, proteinaceous binders, polysaccharides and water-soluble cellulose derivatives. A preferred water-soluble binder for use in the thermographic recording materials of the present invention is gelatine.

The binder to organic silver salt weight ratio is preferably in the range of 0.2 to 7, and the thickness of the thermosensitive element is preferably in the range of 5 to 50 μm. Binders are preferred which do not contain additives, such as certain antioxidants (e.g. 2,6-di-tert-butyl-4-methylphenol), or impurities which adversely affect the thermographic properties of the thermographic recording materials in which they are used.

Toning Agent

According to a fifteenth embodiment of the black and white monosheet thermographic recording material, according to the present invention, the thermosensitive element contains a toning agent, which enables a neutral black image tone to be obtained in the higher densities and neutral grey in the lower densities.

According to a sixteenth embodiment of the black and white monosheet thermographic recording material, according to the present invention, the thermosensitive element further contains a toning agent selected from the group consisting of phthalimides, phthalazinones, benzoxazine diones and naphthoxazine diones e.g. phthalimides and phthalazinones within the scope of the general formulae described in U.S. Pat. No. 4,082,901; the toning agents described in U.S. Pat. Nos. 3,074,809, 3,446,648 and 3,844,797; and the heterocyclic toner compounds of the benzoxazine dione or naphthoxazine dione type as disclosed in GB 1,439,478, U.S. Pat. No. 3,951,660 and U.S. Pat. No. 5,599,647 herein incorporated by reference.

According to a seventeenth embodiment of the black and white monosheet thermographic recording material, according to the present invention, the substantially light-insensitive thermographic material contains a thermosensitive element, the thermosensitive element containing one or more toning agents selected from the group consisting of phthalazinone, benzo[e][1,3]oxazine-2,4-dione, 7-methyl-benzo[e][1,3]oxazine-2,4-dione, 7-methoxy-benzo[e][1,3]oxazine-2,4-dione and 7-(ethylcarbonato)-benzo[e][1,3]oxazine-2,4-dione.

Auxiliary Antifoggants

According to an eighteenth embodiment of the black and white monosheet thermographic recording material, according to the present invention, the thermographic recording material further contains an auxiliary antifoggant to obtain improved shelf-life and reduced fogging.

According to a nineteenth embodiment of the black and white monosheet thermographic recording material, according to the present invention, the thermographic recording material further contains an antifoggant selected from the group consisting of aromatic polycarboxylic acid such as ortho-phthalic acid, 3-nitro-phthalic acid, tetrachlorophthalic acid, mellitic acid, pyromellitic acid and trimellitic acid and anhydrides thereof.

Polycarboxylic Acids and Anhydrides Thereof

According to a twentieth embodiment of the black and white monosheet thermographic recording material, according to the present invention, the thermosensitive element further contains at least one polycarboxylic acid and/or anhydride thereof in a molar percentage of at least 15 with respect to all the organic silver salt(s) present and in thermal working relationship therewith. The polycarboxylic acid may be aliphatic (saturated as well as unsaturated aliphatic and also cycloaliphatic) or an aromatic polycarboxylic acid, may be substituted and may be used in anhydride form or partially esterified on the condition that at least two free carboxylic acids remain or are available in the heat recording step.

Surfactants and Dispersants

Surfactants and dispersants aid the dispersion of ingredients which are insoluble in the particular dispersion medium. The substantially light-insensitive thermographic material used in the present invention may contain one or more surfactants, which may be anionic, non-ionic or cationic surfactants and/or one or more dispersants. Suitable dispersants are natural polymeric substances, synthetic polymeric substances and finely divided powders, e.g. finely divided non-metallic inorganic powders such as silica.

Support

According to a twenty-first embodiment of the black and white monosheet thermographic recording material, according to the present invention, the support is transparent or translucent. It is preferably a thin flexible carrier made transparent resin film, e.g. made of a cellulose ester, e.g. cellulose triacetate, polypropylene, polycarbonate or polyester, e.g. polyethylene terephthalate. The support may be in sheet, ribbon or web form and subbed if needs be to improve the adherence to the thereon coated thermosensitive element. The support may be dyed or pigmented to provide a transparent coloured background for the image.

Protective Layer

According to a twenty-second embodiment of the black and white monosheet thermographic recording material, according to the present invention, the thermosensitive element is provided with a protective layer. In general this protects the thermosensitive element from atmospheric humidity and from surface damage by scratching etc. and prevents direct contact of printheads or heat sources with the recording layers. Protective layers for thermosensitive elements which come into contact with and have to be transported past a heat source under pressure, have to exhibit resistance to local deformation and good slipping characteristics during transport past the heat source during heating. A slipping layer, being the outermost layer, may comprise a dissolved lubricating material and/or particulate material, e.g. talc particles, optionally protruding from the outermost layer. Examples of suitable lubricating materials are a surface active agent, a liquid lubricant, a solid lubricant or mixtures thereof, with or without a polymeric binder.

Photosensitive Silver Halide

The photosensitive silver halide used the present invention may be any photosensitive silver halide such as silver bromide, silver iodide, silver chloride, silver bromoiodide, silver chlorobromoiodide, silver chlorobromide etc. The silver halide may be in any form which is photosensitive including, but not limited to, cubic, orthorhombic, tabular, tetrahedral, octagonal etc. and ay have epitaxial growth of crystals thereon.

The silver halide used in the present invention may be employed without modification. However, it may be chemically sensitized with chemical sensitizing agent such as a compound containing sulphur, selenium, tellurium etc., or a compound containing gold, platinum, palladium, iron, ruthenium, rhodium or iridium etc., a reducing agent such as a tin halide etc., or a combination thereof. The details of these procedures are described in T. H. James, "The Theory of the Photographic Process", Fourth Edition, Macmillan Publishing Co. Inc., New York (1977), Chapter 5, pages 149 to 169.

The grain size of the silver halide particles can be determined by the Moeller Teller method in the sample containing silver halide particles is sedimented upon a filter paper, which is submerged in electrolyte together with a negative platinum needle-shaped electrode and a reference electrode. The silver halide particles on the filter paper are slowly scanned individually with the needle-shaped electrode, whereupon the silver halide grains are individually electrochemically reduced at the cathode. This electrochemical reduction is accompanied by a current pulse, which is registered as a function of time and integrated to give the charge transfer Q for the electrochemical reduction of the silver halide particle, which is proportional to its volume. From their volume the equivalent circular grain diameter of each grain can be determined and therefrom the average particle size and size distribution.

The photosensitive silver halide used in the present invention may be employed in a range of 0.1 to 100 mol percent; preferably, from 0.2 to 80 mol percent; particularly preferably from 0.3 to 50 mol percent; especially preferably from 0.5 to 35 mol %; and especially from 1 to 12 mol % of substantially light-insensitive silver salt of an organic carboxylic acid.

So-called in-situ silver halide can be prepared by conversion of a substantially light-insensitive silver salt of an organic carboxylic acid with a non-fluoro halide ion source such as described in U.S. Pat. No. 3,457,075, WO 97/48104 and WO 97/48105 herein incorporated by reference.

Spectral Sensitizer

The photo-addressable thermally developable element of the photothermographic recording material and aqueous dispersions, according to the present invention, may contain a spectral sensitizer, optionally together with a supersensitizer, for the silver halide appropriate for the wavelength of the light source which may in the near UV, visible, e.g. 630 nm, 670 nm etc., or IR, parts of spectrum. The silver halide may be spectrally sensitized with various known dyes including cyanine, merocyanine, styryl, hemicyanine, oxonol, hemioxonol and xanthene dyes optionally, particularly in the case of sensitization to infra-red radiation, in the presence of a so-called supersensitizer. Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus. In the above described cyanine and merocyanine dyes, those having imino groups or carboxyl groups are particularly effective.

Supersensitizers

According to the present invention the photo-addressable thermally developable element and aqueous dispersions may further include a supersensitizer. Preferred supersensitizers are selected from the group of compounds consisting of: mercapto-compounds, disulfide-compounds, stilbene compounds, organoborate compounds and styryl compounds.

Coating Techniques

The coating of any layer of the substantially light-insensitive thermographic material used in the present invention may proceed by any coating technique e.g. such as described in Modern Coating and Drying Technology, edited by Edward D. Cohen and Edgar B. Gutoff, (1992) VCH Publishers Inc., 220 East 23rd Street, Suite 909 New York, N.Y. 10010, USA. Coating may proceed from aqueous or solvent media with overcoating of dried, partially dried or undried layers.

Thermographic Processing

Thermographic imaging is carried out by the image-wise application of heat either in analogue fashion by direct exposure through an image or by reflection from an image, or in digital fashion pixel by pixel either by using an infra-red heat source, for example with a Nd-YAG laser or other infra-red laser, with a substantially light-insensitive thermographic material preferably containing an infra-red absorbing compound, or by direct thermal imaging with a thermal head.

In thermal printing image signals are converted into electric pulses and then through a driver circuit selectively transferred to a thermal printhead. The thermal printhead consists of microscopic heat resistor elements, which convert the electrical energy into heat via Joule effect. The operating temperature of common thermal printheads is in the range of 300 to 400° C. and the heating time per picture element (pixel) may be less than 1.0 ms, the pressure contact of the thermal printhead with the recording material being e.g. 200–1000 g/linear cm, i.e. with a contact zone (nip) of 200 to 300 μm a pressure of 5000 to 50,000 g/cm$^2$, to ensure a good transfer of heat.

In order to avoid direct contact of the thermal printing heads with the outermost layer on the same side of the support as the thermosensitive element when this outermost layer is not a protective layer, the image-wise heating of the recording material with the thermal printing heads may proceed through a contacting but removable resin sheet or web wherefrom during the heating no transfer of recording material can take place.

Activation of the heating elements can be power-modulated or pulse-length modulated at constant power. EP-A 654 355 discloses a method for making an image by image-wise heating by means of a thermal head having energizable heating elements, wherein the activation of the heating elements is executed duty cycled pulsewise. EP-A 622 217 discloses a method for making an image using a direct thermal imaging element producing improvements in continuous tone reproduction.

Image-wise heating of the recording material can also be carried out using an electrically resistive ribbon incorporated into the material. Image- or pattern-wise heating of the recording material may also proceed by means of pixel-wise modulated ultra-sound.

Photothermographic Printing

Photothermographic recording materials, according to the present invention, may be exposed with radiation of wavelength between an X-ray wavelength and a 5 microns wavelength with the image either being obtained by pixel-wise exposure with a finely focused light source, such as a CRT light source; a UV, visible or IR wavelength laser, such as a He/Ne-laser or an IR-laser diode, e.g. emitting at 780 nm, 830 nm or 850 nm; or a light emitting diode, for example one emitting at 659 nm; or by direct exposure to the object itself or an image therefrom with appropriate illumination e.g. with UV, visible or IR light.

For the thermal development of image-wise exposed photothermographic recording materials, according to the present invention, any sort of heat source can be used that enables the recording materials to be uniformly heated to the development temperature in a time acceptable for the application concerned e.g. contact heating, radiative heating, microwave heating etc.

INDUSTRIAL APPLICATION

Thermographic imaging can be used for the production of reflection type prints and transparencies, in particular for use in the medical diagnostic field in which black-imaged transparencies are widely used in inspection techniques operating with a light box.

The invention is illustrated hereinafter by way of comparative examples and invention examples. The percentages and ratios given in these examples are by weight unless otherwise indicated.

Subbing layers on the emulsion side of the support:

| | |
|---|---|
| copolymer of 88% vinylidene chloride, 10% methyl acrylate and 2% itaconic acid | 170 mg/m$^2$ |
| Kieselsol ® 100F, a colloidal silica from BAYER | 40 mg/m$^2$ |
| Mersolat ® H, a surfactant from BAYER | 0.85 mg/m$^2$ |
| Ultravon ® W, a surfactant from CIBA-GEIGY | 4.0 mg/m$^2$ |

Ingredients in the thermosensitive element in addition to the above-mentioned ingredients:

BL5HP=S-LEC BL5HP, a polyvinyl butyral from SEKISUI;

Oil=BAYSILON, a silicone oil from BAYER;

VL=DESMODUR VL, a 4,4'-diisocyanatodiphenylmethane from BAYER;

Reducing Agents:

R01=3,4-dihydroxybenzonitrile;

R02=3,4-dihydroxybenzophenone;

Toning Agent:

T01=7-(ethylcarbonato)-benzo[e][1,3]oxazine-2,4-dione;

T02=7-methyl-benzo[e][1,3]oxazine-2,4-dione;

Stabilizers:

S01=glutaric acid

S02=tetrachlorophthalic acid anhydride

S03 = benzotriazole

COMP −1 =

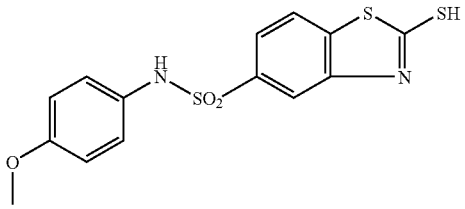

COMP −2 =

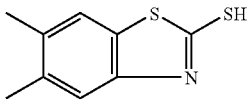

COMP −3 =

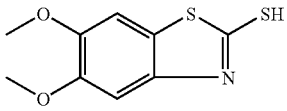

COMP −4 =

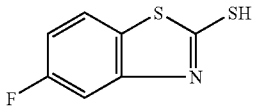

COMP −5 =

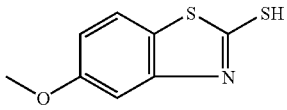

COMP −6 =

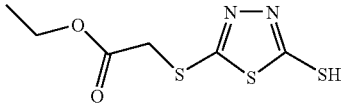

COMP −7 =

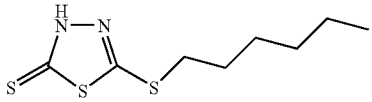

COMP −8 =

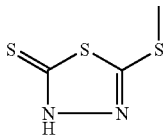

COMP −9 =

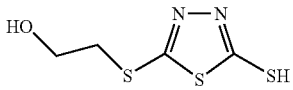

Ingredients in the Protective Layer:

ERCOL™ 48 20=a polyvinylalcohol from ACETEX EUROPE;

LEVASIL™ VP AC 4055=a 15% aqueous dispersion of colloidal silica with acid groups predominantly neutralized with sodium ions and a specific surface are of 500 m$^2$/g, from BAYER AG has been converted into the ammonium salt;

ULTRAVON™ W=75–85% concentrate of a sodium arylsulfonate from Ciba Geigy converted into acid form by passing through an ion exchange column;

SYLOID™ 72=a silica from Grace;

SERVOXYL™ VPDZ 3/100=a mono[isotridecyl polyglycolether (3 EO)] phosphate, from SERVO DELDEN B.V.;

SERVOXYL™VPAZ 100=a mixture of monolauryl and dilauryl phosphate, from SERVO DELDEN B.V.;

MICROACE TALC P3=an Indian talc from NIPPON TALC;

RILANIT™ GMS=a glycerine monotallow acid ester, from HENKEL AG

TMOS=tetramethylorthosilicate hydrolyzed in the presence of methanesulfonic acid.

COMPARATIVE EXAMPLES 1 TO 7 AND INVENTION EXAMPLES 1 TO 4

The substantially light-insensitive thermographic materials of COMPARATIVE EXAMPLES 1 to 7 and INVENTION EXAMPLES 1 to 4 were prepared by coating a dispersion with the following ingredients in 2-butanone onto a 175 μm thick blue-pigmented polyethylene terephthalate support with CIELAB a*- and b*-values of −9.5 and −17.9 respectively subbed on the emulsion-coated side with subbing layer giving layers after drying at 85° C. for 3 minutes in a drying cupboard with the compositions given in Table 1.

TABLE 1

| | stabilizer | | | | R01 | R02 | T01 | T02 | S01 | S02 | | |
|---|---|---|---|---|---|---|---|---|---|---|---|---|
| | type | conc. mol % vs AgB | AgBeh coverage [g/m$^2$] | BL5HP [g/m$^2$] | mol % vs AgB | mol % vs AgB | mol % vs AgB | mol % vs AgB | mol % vs AgB | mol % vs AgB | VL [g/m$^2$] | Oil [g/m$^2$] |
| Comparative example nr. | | | | | | | | | | | | |
| 1 | — | 10 | 4.15 | 16.6 | 35 | 45 | 0 | 15 | 24 | 4.91 | 0.19 | 0.037 |
| 2 | S03 | 10 | 4.15 | 16.6 | 35 | 45 | 0 | 15 | 24 | 4.91 | 0.19 | 0.037 |
| 3 | COMP-1 | 10 | 4.15 | 16.6 | 35 | 45 | 0 | 15 | 24 | 4.91 | 0.19 | 0.037 |
| 4 | COMP-2 | 10 | 4.15 | 16.6 | 35 | 45 | 0 | 15 | 24 | 4.91 | 0.19 | 0.037 |
| 5 | COMP-3 | 10 | 4.15 | 16.6 | 35 | 45 | 0 | 15 | 24 | 4.91 | 0.19 | 0.037 |
| 6 | COMP-4 | 10 | 4.15 | 16.6 | 35 | 45 | 0 | 15 | 24 | 4.91 | 0.19 | 0.037 |
| 7 | COMP-5 | 10 | 4.15 | 16.6 | 35 | 45 | 0 | 15 | 24 | 4.91 | 0.19 | 0.037 |
| Invention example nr | | | | | | | | | | | | |
| 1 | TDZ-03 | 10 | 4.15 | 16.6 | 35 | 45 | 0 | 15 | 24 | 4.91 | 0.19 | 0.037 |
| 2 | TDZ-04 | 10 | 4.15 | 16.6 | 35 | 45 | 0 | 15 | 24 | 4.91 | 0.19 | 0.037 |
| 3 | TDZ-05 | 10 | 4.15 | 16.6 | 35 | 45 | 0 | 15 | 24 | 4.91 | 0.19 | 0.037 |
| 4 | TDZ-10 | 10 | 4.15 | 16.6 | 35 | 45 | 0 | 15 | 24 | 4.91 | 0.19 | 0.037 |

The thermosensitive elements were then coated with an aqueous composition with the following ingredients, which was adjusted to a pH of 3.8 with 1N nitric acid, to a wet layer thickness of 85 μm and then dried at 50° C. for 15 minutes to produce a protective layer PRO-L with the composition:

| | |
|---|---|
| ERCOL ™ 48 20 = | 2.1 g/m$^2$ |
| LEVASIL ™ VP AC 4055 = | 1.05 g/m$^2$ |
| ULTRAVON ™ W = | 0.075 g/m$^2$ |
| SYLOID ™ 72 = | 0.09 g/m$^2$ |
| SERVOXYL ™ VPDZ 3/100 = | 0.075 g/m$^2$ |
| SERVOXYL ™ VPAZ 100 = | 0.075 g/m$^2$ |
| MICROACE TALC P3 = | 0.045 g/m$^2$ |
| RILANIT ™ GMS = | 0.15 g/m$^2$ |

-continued

| | |
|---|---|
| TMOS = | 0.87 g/m$^2$ (assuming that the TMOS was completely converted to $SiO_2$) |

After coating the protective layer was hardened by heating the substantially light-insensitive thermographic material at 45° C. for 7 days at a relative humidity of 70%.

Thermographic Printing

The substantially light-insensitive thermographic recording materials of COMPARATIVE EXAMPLES 1 to 7 and INVENTION EXAMPLES 1 to 4 were printed using a DRYSTAR™ 4500 printer from AGFA-GEVAERT with a resolution of 508 dpi which had been modified to operate at a printing speed of 14 mm/s and a line-time of 3.5 ms instead of 7.1 ms and in which the 75 μm long (in the transport direction) and 50 μm wide thermal head resistors were power-modulated to produce different image densities.

The maximum densities of the images ($D_{max}$) were measured through a visible filter with a MACBETH™ TR924 densitometer.

Evaluation of Thermographic Properties

The image tone of fresh prints made with the substantially light-insensitive thermographic recording materials of COMPARATIVE EXAMPLES 1 to 7 and INVENTION EXAMPLES 1 to 4 were assessed on the basis of the L*, a* and b* CIELAB-values at optical densities, D, of 1.0 and 2.0 and the results given in Table 2.

Archivability Tests:

Simulated long-term archivability tests were performed by heating prints made with the substantially light-insensitive thermographic recording materials of COMPARATIVE EXAMPLES 1 to 7 and INVENTION EXAMPLES 1 to 4 at 57° C. in 34% relative humidity in the dark for 3 days and determining the shifts in CIELAB a*- and b*-values. The results are also given in Table 2.

Light-box Tests:

Light-box tests were performed by exposing the substantially light-insensitive thermographic materials of COMPARATIVE EXAMPLES 1 to 7 and INVENTION EXAMPLES 1 to 4 for 3 days on top of the white PVC window of a specially constructed light-box placed in a Votsch conditioning cupboard set at 30° C. and a relative humidity of 85%. Only a central area of the window 550 mm long by 500 mm wide was used for mounting the test materials to ensure uniform exposure.

The stainless steel light-box used was 650 mm long, 600 mm wide and 120 mm high with an opening 610 mm long and 560 mm wide with a rim 10 mm wide and 5 mm deep round the opening, thereby forming a platform for a 5 mm thick plate of white PVC 630 mm long and 580 mm wide, making the white PVC-plate flush with the top of the light-box and preventing light loss from the light-box other than through the white PVC-plate. This light-box was fitted with 9 Planilux™ TLD 36W/54 fluorescent lamps 27 mm in diameter mounted length-wise equidistantly from the two sides, with the lamps positioned equidistantly to one another and the sides over the whole width of the light-box and with the tops of the fluorescent tubes 30 mm below the bottom of the white PVC plate and 35 mm below the materials being tested. The shifts in CIELAB a*- and b*-values at an optical density, D, of 1.0 and the shift in the CIELAB b*-value were determined for COMPARATIVE EXAMPLES 1 to 7 and INVENTION EXAMPLES 1 to 4 and the results are also given in Table 2.

In these tests the substantially light-insensitive thermographic recording materials of INVENTION EXAMPLES 1 to 4 whose thermosensitive elements contain TDZ-03, TDZ-04, TDZ-05 and TDZ-10, optionally substituted, optionally annelated five-membered heterocyclic ring compounds according to the present invention, instead of benzotriazole surprisingly exhibited better CIELAB b*-stability in archivability tests and much higher Dmax values than those observed with thermographic recording materials of COMPARATIVE EXAMPLES 3 to 7 whose thermosensitive elements contained optionally substituted, optionally annelated five-membered heterocyclic ring compounds all with the five-membered ring directly substituted with a mercapto group. The higher Dmax-values obtained with the substantially light-insensitive thermographic recording materials of INVENTION EXAMPLES 1 to 4 indicated that the use of TDZ-03, TDZ-04, TDZ-05 and TDZ-10, optionally substituted, optionally annelated heterocyclic five-membered ring compounds according to the present invention, enabled a higher Dmax for a given coverage per unit area of substantially light-insensitive organic silver salt to be realized.

TABLE 2

| | | Fresh film | | | ΔCIELAB-values at D = 1.0 for prints | | ΔCIELAB-values of prints after 3 d/30° C./85% RH light-box exposure | | |
|---|---|---|---|---|---|---|---|---|---|
| | stabilizer | | CIELAB-values of prints D = 1.0 | | after 3 d/57° C./34% RH in dark | | D = 1.0 | | Dmin |
| | type | Dmax | a* | b* | Δa* | Δb* | Δa* | Δb* | Δb* |
| Comparative Example nr. | | | | | | | | | |
| 1 | — | 3.00 | −2.93 | −6.53 | −0.13 | +2.31 | +0.02 | +0.68 | +2.70 |
| 2 | S03 | 2.80 | −1.87 | −10.04 | −1.16 | +2.34 | −0.19 | +0.57 | +1.48 |
| 3 | COMP-1 | 2.55 | −2.85 | −9.25 | −0.23 | +3.75 | +0.26 | +0.55 | +1.23 |
| 4 | COMP-2 | 2.48 | −2.13 | −9.48 | +0.38 | +5.76 | +0.46 | +1.23 | +0.91 |
| 5 | COMP-3 | 2.59 | −2.70 | −9.59 | −0.04 | +3.66 | +0.27 | +1.04 | +1.25 |
| 6 | COMP-4 | 2.53 | −2.80 | −9.83 | −0.27 | +3.7 | +0.29 | +2.10 | +1.55 |
| 7 | COMP-5 | 2.46 | −3.02 | −7.43 | +0.10 | +3.02 | +0.30 | +1.08 | +1.37 |
| Invention Example | | | | | | | | | |
| 1 | TDZ-03 | 3.10 | −3.05 | −6.91 | −0.32 | +1.53 | −0.13 | +0.11 | +1.99 |
| 2 | TDZ-04 | 3.20 | −3.06 | −7.22 | −0.16 | +1.82 | +0.22 | +2.54 | +2.19 |
| 3 | TDZ-05 | 3.20 | −2.71 | −6.29 | −0.22 | +1.52 | +0.14 | +0.65 | +1.94 |
| 4 | TDZ-10 | 3.10 | −2.85 | −7.36 | −0.44 | +1.33 | −0.06 | +0.48 | +2.37 |

Surprisingly the thermographic recording materials of INVENTION EXAMPLES 1 to 4 containing TDZ-03, TDZ-04, TDZ-05 and TDZ-10 respectively instead of benzotriazole exhibited significantly higher maximum image densities, Dmax, when compared with the thermographic recording material of COMPARATIVE EXAMPLE 2 with benzotriazole, indicating a higher Dmax for a given coverage per unit area of substantially light-insensitive organic silver salt.

The thermographic recording material of COMPARATIVE EXAMPLES 1, in which the benzotriazole was omitted, a worse CIELAB b*-stability upon exposure in the light box than the thermographic recording material of COMPARATIVE EXAMPLE 2 containing benzotriazole.

The thermographic recording materials of INVENTION EXAMPLES 1 to 4 containing TDZ-03, TDZ-04, TDZ-05 and TDZ-10 respectively instead of benzotriazole exhibit comparable image tone of the fresh print, comparable CIELAB a*-archivability, improved CIELAB b*-archivability and better or comparable stability in light box experiments in addition to higher Dmax values.

COMPARATIVE EXAMPLES 8 TO 13

The substantially light-insensitive thermographic materials of COMPARATIVE EXAMPLES 8 to 13 were prepared by coating a dispersion with the following ingredients in 2-butanone onto the support described for COMPARATIVE EXAMPLES 1 to 7 and INVENTION EXAMPLES 1 to 4 giving layers after drying at 85° C. for 3 minutes in a drying cupboard with the compositions given in Table 3.

TABLE 3

| Comparative example nr. | stabilizer type | stabilizer conc. mol % vs AgB | AgBeh coverage [g/m²] | BL5HP [g/m²] | R01 mol % vs AgB | R02 mol % vs AgB | T01 mol % vs AgB | T02 mol % vs AgB | S01 mol % vs AgB | S02 mol % vs AgB | VL [g/m²] | Oil [g/m²] |
|---|---|---|---|---|---|---|---|---|---|---|---|---|
| 3 | — | 10 | 3.89 | 15.12 | 50 | 30 | 5 | 10 | 22 | 5 | 0.17 | 0.035 |
| 4 | S03 | 10 | 3.89 | 15.12 | 50 | 30 | 5 | 10 | 22 | 5 | 0.17 | 0.035 |
| 5 | COMP-6 | 10 | 3.89 | 15.12 | 50 | 30 | 5 | 10 | 22 | 5 | 0.17 | 0.035 |
| 6 | COMP-7 | 10 | 3.89 | 15.12 | 50 | 30 | 5 | 10 | 22 | 5 | 0.17 | 0.035 |
| 7 | COMP-8 | 10 | 3.89 | 15.12 | 50 | 30 | 5 | 10 | 22 | 5 | 0.17 | 0.035 |
| 8 | COMP-9 | 10 | 3.89 | 15.12 | 50 | 30 | 5 | 10 | 22 | 5 | 0.17 | 0.035 |

The thermosensitive elements were then provided with a protective layer as described for COMPARATIVE EXAMPLES 1 to 7 and INVENTION EXAMPLES 1 to 4.

The thermographic properties of the substantially light-insensitive thermographic recording materials of COMPARATIVE EXAMPLES 8 to 13 were evaluated as described for COMPARATIVE EXAMPLES 1 to 7 and INVENTION EXAMPLES 1 to 4. The results are given in Table 4.

In these tests the thermographic recording materials of COMPARATIVE EXAMPLES 10 to 13 whose thermosensitive elements contain 1-thia-3,4-diazole compounds with a mercapto (—SH) group instead of benzotriazole exhibited very poor CIELAB b*-stability to light box exposure, particularly with regard to Dmin-stability.

Comparison of the results of COMPARATIVE EXAMPLES 3 and 4 with those of COMPARATIVE EXAMPLES 1 to 7 in both cases without a stabilizer and with benzotriazole as stabilizer respectively shows that the shift in imaging properties as a result of using slightly different configurations of thermographic recording materials is insufficient to explain the much worse CIELAB b*-stability to light box exposure observed with the substantially light-insensitive thermographic recording materials of COMPARATIVE EXAMPLES 5 to 8 with the optionally substituted, optionally annelated five-membered heterocyclic ring compounds of COMP-6 to COMP-9 all with the five-menbered ring directly substituted with a mercapto group compared with the results obtained with INVENTION EXAMPLES 1 to 43 with the optionally substituted, optionally annelated five-membered heterocyclic ring compounds TDZ-03, TDZ-043, TDZ-05 and TDZ-10 according to the present invention.

Furthermore, the substantially light-insensitive thermographic recording materials of COMPARATIVE EXAMPLES 10 to 13, whose thermosensitive elements contain COMP-6 to COMP-9 exhibit Dmax values which are no higher than the substantially light-insensitive thermographic recording materials of COMPARATIVE EXAMPLES 8 and 9 with no stabilizer and benzotriazole respectively indicating no increase in Dmax for a given coverage per unit area of substantially light-insensitive organic silver salt with optionally annelated five-membered heterocyclic ring compounds outside the scope of the present invention.

TABLE 4

| Comaprative Example nr. | stabilizer type | Dmax | Fresh film CIELAB-values of prints D = 1.0 a* | b* | ΔCIELAB-values at D = 1.0 for prints after 3 d/57° C./34% RH in dark Δa* | Δb* | ΔCIELAB-values of prints after 3 d/30° C./85% RH light-box exposure D = 1.0 Δa* | Δb* | Dmin Δb* |
|---|---|---|---|---|---|---|---|---|---|
| 8 | — | 3.00 | −3.18 | −8.04 | −0.19 | +3.21 | +0.11 | +2.30 | +2.68 |
| 9 | S03 | 2.70 | −1.96 | −10.68 | −0.01 | +2.85 | +0.03 | +0.58 | +1.62 |
| 10 | COMP-6 | 3.00 | −4.11 | −4.43 | −0.07 | −1.37 | +0.71 | +4.36 | +15.48 |
| 11 | COMP-7 | 3.00 | −3.76 | −4.7 | +0.97 | +0.16 | +0.65 | +4.16 | +13.12 |
| 12 | COMP-8 | 2.90 | −3.84 | −4.89 | −0.04 | −0.73 | +3.41 | +26.99 | +34.03 |
| 13 | COMP-9 | 2.50 | −4.37 | −5.19 | +0.87 | +1.95 | +1.43 | +10.65 | +18.35 |

The present invention may include any feature or combination of features disclosed herein either implicitly or explicitly or any generalisation thereof irrespective of whether it relates to the presently claimed invention. In view of the foregoing description it will be evident to a person skilled in the art that various modifications may be made within the scope of the invention.

Having described in detail preferred embodiments of the current invention, it will now be apparent to those skilled in the art that numerous modifications can be made therein without departing from the scope of the invention as defined in the following claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A black and white monosheet thermographic recording material comprising a support and a thermosensitive element, said thermosensitive element comprising a substantially light-insensitive organic silver salt, an organic reducing agent therefor in thermal working relationship therewith, a binder and at least one five-membered beterocyclic ring compound selected from the group consisting of optionally substituted, optionally annelated 1-thia-2,3-diazole compounds; optionally substituted, optionally annelated 1-thia-2,5-diazole compounds; optionally substituted 1-thia-2,4-diazole compounds; optionally substituted 1-thia-3,4-diazole compounds; optionally substituted thiatriazole compounds; optionally substituted, optionally annelated 1-seleno-2,3-diazole compounds; optionally substituted, optionally annelated 1-seleno-2,5-diazole compounds; optionally substituted 1-seleno-2,4-diazole compounds; optionally substituted 1-seleno-3,4-diazole compounds; and optionally substituted selenotriazole compounds, with the proviso that said at least one five-membered heterocyclic ring compound is not substituted with or does not contain a mercapto, a —$SO_2CBr_3$, a —S-alkylene-COOH or a N-acyl-hydrazine group.

2. The thermographic recording material according to claim 1, wherein said at least one optionally annelated five-membered heterocyclic ring compound is annelated with a benzene or a naphthalene ring.

3. The thermographic recording material according to claim 1, wherein said at least one five-membered heterocyclic ring compound is represented by formula (I):

(I)

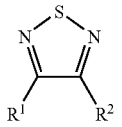

wherein $R^1$ and $R^2$ are independently a hydrogen or a halogen atom or an optionally substituted alkyl, alkenyl, alkynyl, alicyclic, aryl, aralkyl, alkaryl, heterocyclic, heteroaromatic, alkoxy, thio-alkoxy, aryloxy, amino, amido, carboxy, carboxy ester, acyl, carbonate, carbonato-ester or a $SO_2R^3$ group, wherein $R^3$ is an alkyl, alkenyl, alkynyl, alicyclic, aryl, aralkyl, alkaryl, heterocyclic or heteroaromatic group; or $R^1$ and $R^2$ together constitute the atoms necessary to form an optionally substituted heterocyclic, alicyclic, aromatic or heteroaromatic ring or ring system.

4. The thermographic recording material according to claim 1, wherein said at least one five-membered heterocyclic ring compound is represented by formula (II):

(II)

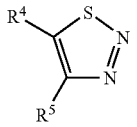

wherein $R^4$ and $R^5$ are independently a hydrogen or a halogen atom or an optionally substituted alkyl, alkenyl, alkynyl, alicyclic, aryl, aralkyl, alkaryl, heterocyclic, heteroaromatic, alkoxy, thio-alkoxy, aryloxy, amino, amido, carboxy, carboxy ester, acyl, carbonato, carbonato-ester or a $SO_2R^6$ group, wherein $R^6$ is an alkyl, alkenyl, alkynyl, alicyclic, aryl, aralkyl, alkaryl, heterocyclic or heteroaromatic group; or $R^4$ and $R^5$ together constitute the atoms necessary to form an optionally substituted heterocyclic, alicyclic, aromatic or heteroaromatic ring or ring system.

5. The thermographic recording material according to claim 1, wherein said at least one five-membered heterocyclic ring compound is represented by formula (III):

(III)

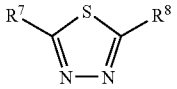

wherein $R^7$ and $R^8$ are independently a hydrogen or a halogen atom or an optionally substituted alkyl, alkenyl, alkynyl, alicyclic, aryl, aralkyl, alkaryl, heterocyclic, heteroaromatic, alkoxy, thio-alkoxy, aryloxy, amino, amido, carboxy, carboxy ester, acyl, carbonato, carbonato-ester or a $SO_2R^9$ group, wherein $R^9$ an alkyl, alkenyl, alkynyl, alicyclic, aryl, aralkyl, alkaryl, heterocyclic or heteroarornatic group.

6. The thermographic recording material according to claim 1, wherein said at least one five-membered heterocyclic ring compound is represented by formula (IV):

(IV)

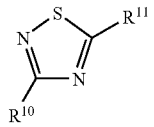

wherein $R^{10}$ and $R^{11}$ are independently a hydrogen or a halogen atom or an optionally substituted alkyl, alkenyl, alkynyl, alicyclic, aryl, aralkyl, alkaryl, heterocyclic, heteroarornatic, alkoxy, thio-alkoxy, aryloxy, amino, amido, carboxy, carboxy ester, acyl, carbonate, carbonato-ester or a $SO_2R^{12}$ group, wherein $R^{12}$ is an alkyl, alkenyl, alkynyl, alicyclic, aryl, aralkyl, alkaryl, heterocyclic or heteroaromatic group.

7. The thermographic recording material according to claim 1, wherein said at least one five-membered heterocyclic ring compound is

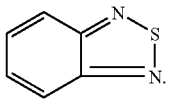

8. The thermographic recording material according to claim 1, wherein said at least one five-membered heterocyclic ring compound is

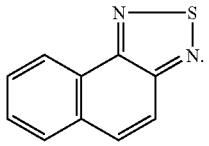

9. The thermographic recording material according to claim 1, wherein said at least one five-membered heterocyclic ring compound is

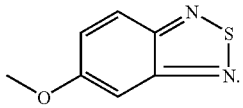

10. The thermographic recording material according to claim 1, wherein said at least one five-membered heterocyclic ring compound is

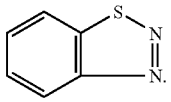

11. The thermographic recording material according to claim 1, wherein said thermographic recording material is a substantially light-insensitive thermographic recording material.

* * * * *